US006874785B2

(12) United States Patent
Miller

(10) Patent No.: US 6,874,785 B2
(45) Date of Patent: Apr. 5, 2005

(54) GAME CARDS

(75) Inventor: Terence Miller, Lafayette, IN (US)

(73) Assignee: Dare Action Limited, Newark (GB)

( * ) Notice: Subject to any disclaimer, the term of this patent is extended or adjusted under 35 U.S.C. 154(b) by 0 days.

(21) Appl. No.: 10/310,563

(22) Filed: Dec. 4, 2002

(65) Prior Publication Data

US 2003/0184016 A1 Oct. 2, 2003

(30) Foreign Application Priority Data

Mar. 26, 2002 (GB) ..... 0207067

(51) Int. Cl.[7] ..... A63F 1/02
(52) U.S. Cl. ..... 273/293; D21/376; D21/378
(58) Field of Search ..... 273/293, 292; D21/376, 378

(56) References Cited

U.S. PATENT DOCUMENTS 1,766,465 A * 6/1930 Snelling ..... 273/293
3,154,863 A * 11/1964 Prelle ..... 273/293
D204,993 S * 6/1966 Brothers ..... D21/376
3,263,999 A * 8/1966 McCoy ..... 273/293
3,492,000 A * 1/1970 Board ..... 273/293

* cited by examiner

*Primary Examiner*—Benjamin Layno
(74) *Attorney, Agent, or Firm*—Higgs, Fletcher & Mack LLP; Charles F. Reidelbach, Jr.

(57) ABSTRACT

A set of cards for playing a card game is described. Each of said cards is printed with indicia essential for the playing of the game and one or more of said cards is printed with such indicia towards a central region of the card, that is inwardly disposed from the perimeter edge. In accordance with the invention, one or more of said cards in the set is provided with one or more apertures in predetermined locations within said central region to allow at least some of the indicia printed in the central region of a first card to be seen through the apertures of second and optionally further cards when said second and further cards are superposed over said first card.

9 Claims, 2 Drawing Sheets

GAME CARDS

Figure 1:
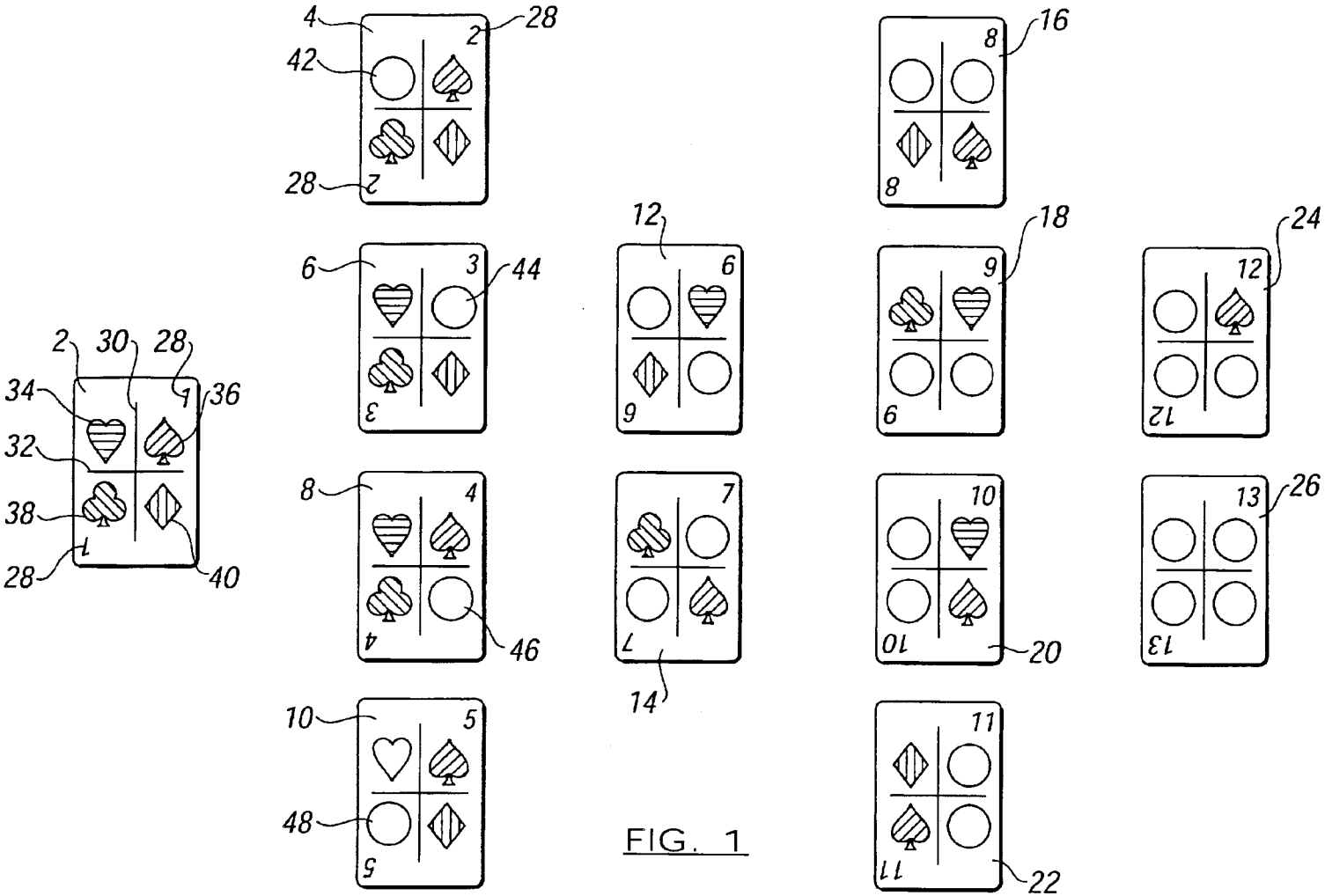

This invention relates to improved game cards and more specifically to improved game cards which are printed on either or both of the front and rear faces of the card with indicia relevant to the game to be played, and in certain circumstances the indicia may be generic such as those on conventional playing cards.

Although the following description is provided with almost exclusive reference to conventional playing cards usually numbering 52 in total and consisting of four sets of 13 cards, each set being of a different suit, the reader will appreciate from the description of the invention provided hereinafter that the invention is of far wider scope and indeed the indicia printed on the front or rear surfaces of the card need not be in the style of conventional playing cards, and furthermore may be any type of indicia such as comic or cartoon characters, animals, letters, and any other indicia which may have a meaning or importance in the play of the game for which the cards are to be used. Obviously however, if the indicia are generalized such as those appearing on conventional playing cards, the game cards of the invention may be used to play a wide variety of different games.

The reader will be well aware of the nature of conventional playing cards. Typically such cards are provided with a constant and identical pattern on their rear surface and printed with indicia marking the denomination (A or 1, 2, 3, 4, 5, 6, 7, 8, 9, 10, J, Q, K) and suit (hearts, diamonds, clubs and spades) of the card on the front surface. In practically all cases, while there may be a variety of different patterns and indicia printed in the central region of the front surface of the card, the denomination and suit are usually always printed in either or both pairs of diagonally opposite corners to aid rapid identification by the recipient of the cards when they are gradually fanned out as they might be during the inspection of a stack or collection of such cards. For instance, when a set number of cards is dealt to a player of the game, the player gathers the face down cards together into a small stack and lifts this stack from the table. In an effort to conceal the cards from other players with whom that particular player may be adjacent, he will gradually fan the cards out in his hands so that, with the exception of the card which is front most in the stack and whose entire front surface may be seen, only the one corner of the remaining cards may be seen by the player. The card denomination and suit are printed in the corners of the cards to enable this type of concealed viewing by the player.

In general, all card games involve some form of discarding and collecting operations, but other than the denominations and the suits being of relevance, there is no interaction between two or more cards in any game of cards currently known. For instance, while it is known that collectively, groups of cards may be particularly strong or weak in certain games (e.g. a run of cards all of the same suit), there is currently no card game played wherein the fact that two or more cards are superposed connotes additional significance or importance beyond the fact that the denominations and suits of those two or more cards may collectively be useful, advantageous, or important as regards the particular game being played.

Accordingly, it is a fundamental object of this invention to provide a set of game cards of generally identical size and shape and being printed with indicia which provides an additional dimension and optionally an additional degree of complexity to games played with such cards which has heretofore not been considered.

It is a further object of this invention to provide a set of cards printed on at least one surface with varying indicia which may include characters, letters, numerals, animals, suits and the like and the superposition of at least two or more of which connotes a special significance, importance, advantage or disadvantage in the gameplay which is not attributable to the cards when placed side by side.

According to the invention there is provided a set of cards for playing a card game, each of said cards being printed with indicia relevant to the game and one or more of said cards being printed with such indicia towards a central region of the card, characterized in that one or more of said cards in the set is provided with one or more apertures in predetermined locations within said central region to allow at least some of the indicia printed in the central region of a first card to be seen through the apertures of second and optionally further cards when said second and further cards are superposed over said first card.

Preferably the indicia are character based, such as coloured animals, cartoon characters, letters, conventional playing card suits and the like.

In one aspect of the invention, the cards are printed with a plurality of similar but differently coloured indicia in the central region thereof.

Most preferably, the indicia printed on the said and further cards which are superposed on the first card printed with similar but differently coloured indicia consist of scenes surrounding the aperture in said second and further cards through which the indicia of the first card may be seen, said scenes being chosen such that the appearance of the indicia of the first card therethrough when the cards are superposed will appear comical or otherwise unusual to a player of the game.

In a different aspect of the invention, the central regions of the majority of the cards in the set are printed with one or more of the conventional playing card suits.

Most preferably, the central region of the cards is divided by one or more lines to define a plurality of portions of said central region.

It is yet further preferable that in each portion of said central region of said card, there is provided either an aperture or printed indicia consisting of a single denomination, character suit shape or the like.

Most preferably, the central region is divided into four portion by a series of two perpendicularly intersecting lines, and the case where no aperture is provided, most preferably the card is printed with indicia consisting of the four conventional playing card suits, one each in each portion of the central region defined by said intersecting lines.

Most preferably within the set of cards, there will be some having no apertures and being discretely printed only with indicia in the portions of their central regions, some having only a single aperture in one of the portions within said central region, indicia being printed in the remaining portions of said central region, some having two apertures provided in two of the portions within said central region, indicia being printed in the remaining portions of said central region, some having three apertures in three of the portions within said central region, indicia being printed in the remaining portion of said central region, and one or more having four apertures provided in each of the portions of the said central region, no indicia be provided elsewhere in said central region.

Figure 2:
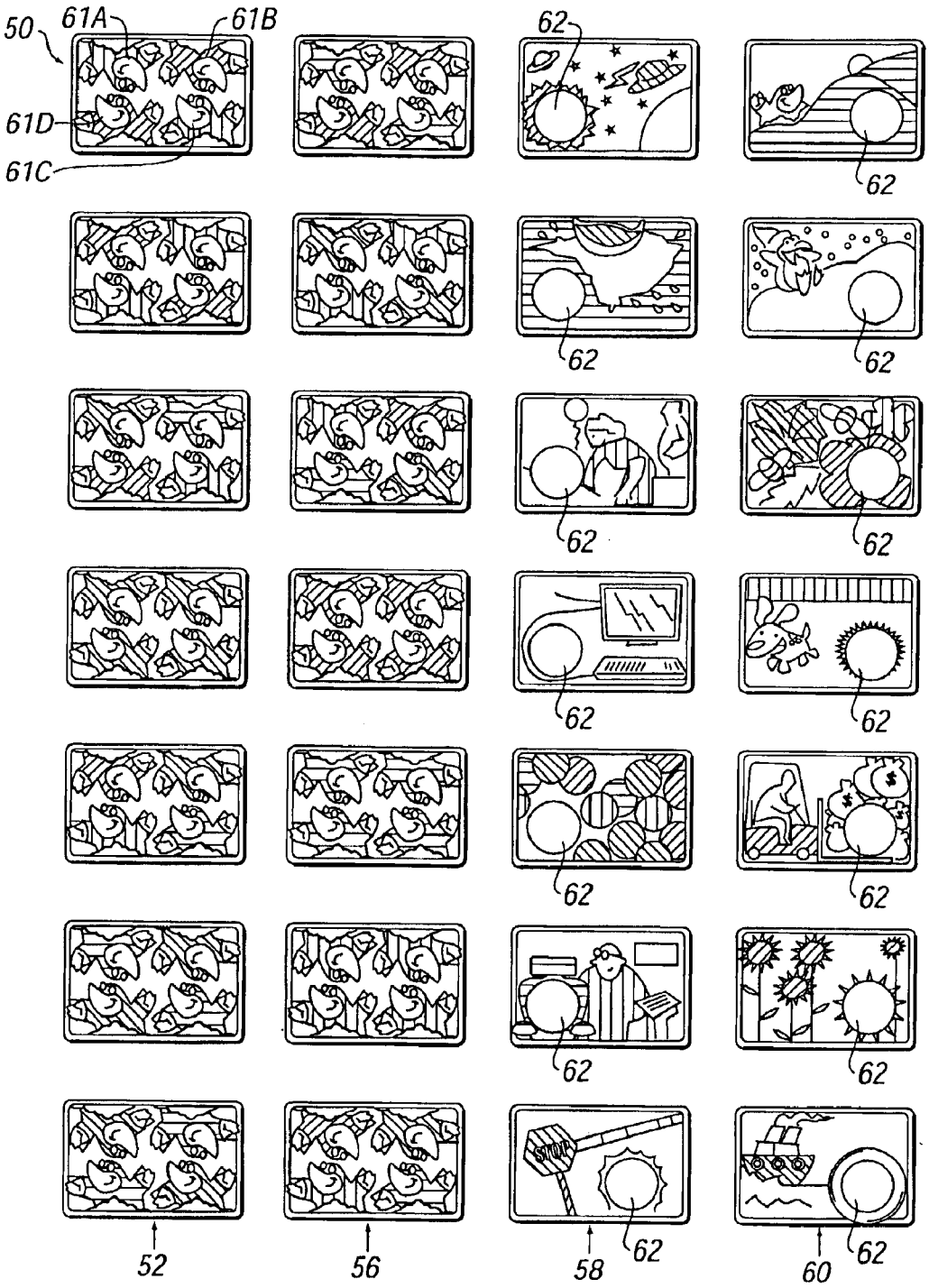

A specific embodiment of the invention will now be given by way of example only with reference to the accompanying diagrams wherein FIG. 1 shows a set of cards according to a first aspect of the invention with their front surfaces face up showing the printed indicia and apertures provided thereon/therein and FIG. 2 shows a set of cards according to a first aspect of the invention with their front surfaces face up showing the printed indicia and apertures provided thereon/therein Referring firstly to FIG. 1 there is shown a set of 13 game cards 2, 4, 6, 8, 10, 12, 14, 16, 18, 20, 22, 24, 26 which may form the entire set or be part of a set of cards adapted for playing certain types of games.

Card 2 is not provided with any apertures but is printed on the one hand with a denominating mark 28 indicating the number or value of the card. This mark is also printed in upturned orientation in the diagonally opposite corner of the card, and such denominating marks are also printed in the corresponding corners of all the other cards 4–26 as shown. Each of the cards is provided with a pair of perpendicularly intersecting lines 30, 32 which define four separate portions 34, 36, 38, 40 of a central region of each card (not numbered, but generally inset from the peripheral edge of the card in all circumstances). It is in these portions of the card that indicia may be printed or apertures may be provided according the particular set of cards which is being manufactured, or the particular game which the cards are to be used to play.

It is further to be seen from the Figure that cards 4–26 are provided with one, two, three or four apertures 42, 44, 46, 48 (numbered according to their position on the card), and the position of these apertures is generally the same as the position in which one of the types of indicia would have been printed had the aperture not been there. Accordingly, those cards with apertures can be superposed on top of other cards not having apertures in that particular portion of the central region, and the indicia printed on the lower card can then be seen through the aperture of the upper card. The effect achieved is that the missing indicia of a particular set, for instance in the case of card 4 can be made up by superposing this card on top of card two so that the indicia in portion 34 can be seen through aperture 42.

It can be seen from the figure that within the set, there are various combinations and permutations available, and it is also to be mentioned that a fiendishly complex game could be contrived using only a simple set of cards. For instance, in the figure, the indicia printed in the portions 34, 36, 38, 40 are always in the same position, but this need not be the case. Furthermore, the indicia may be the same or different colours forming a yet further subset with the set of cards, and of course in most cases there would be a greater number than 13 cards which would form the overall set.

Referring to FIG. 2, a second set 50 of cards is shown arranged in columns 52, 56, 58, 60 of 7 cards adapted for the play of a much simpler game than that which may be contrived using the set of cards shown in FIG. 1. In FIG. 2, each of the cards in columns 52, 56, is not provided with an aperture, but instead the central region of the cards is printed with a series of four identical cartoon characters 61A, 61B, 61C, 61D, which may be printed in the same or different colours. In columns 58, 60, the cards are provided with only a single aperture 62 in one of two possible positions on the card.

Depending on the manner in which the cards of the columns 58, 60 are superposed on the cards of columns 52, 56, one or other of the cartoon characters will be visible through said aperture.

Hence, although the rules of the games which might be played with the sets of cards described in this application have not been defined, this is not seen in anyway to detract from the fact that the inventor has devised a particularly interesting and inventive set of cards which could easily be adapted for use in the play of some particularly fiendish and complex games.

Furthermore, the inventor has found a means of extending the game play possible with a conventional set of playing cards with only the slight alteration of providing apertures in particular locations, and accordingly an additional dimension can now be added to card games in that not only are the denominations and optionally the suits of cards important, but the manner in which such cards are superposed can now be considered as important and could easily and without much skill be included as a further element of a card game.

What is claimed is:

1. A set of cards for playing a card game, each of said cards being printed with indicia relevant to the game and having a central region with a plurality of predetermined locations, the indicia being printed at one or more of the predetermined locations, one or more of said cards in the set is provided with apertures defined at one or more of the predetermined locations, each card of the set having both a numerical and a non-numerical value associated therewith represented by the indicia and apertures and, in playing a game, indicia printed in the central region in at least a first card of the set can be seen through one or more of the apertures on a second and optionally further cards when said second and further cards are superposed over the first card, thereby altering the value associated with said second and further cards.

2. A set of cards according to claim 1 characterised in that the cards are printed with a plurality of similar but differently colored indicia in the central region thereof.

3. A set of cards according to claim 1 characterised in that the first card in a stack of superposed cards is printed with a certain type of indicia, the said further cards which are superposed on the first card being printed with similar but differently colored indicia and consisting of scenes surrounding the aperture in said second and further cards through which the indicia of the first card may be seen, said scenes being chosen such that the appearance of the indicia of the first card through the apertures of the one or more further cards superposed thereon appear comical or otherwise unusual to a player of the game.

4. A set of cards according to claim 1 characterised in that the central regions of the majority of the cards in the set are printed with one or more of the conventional playing card suits.

5. A set of cards according to claim 1 characterised in that the central region of the cards is divided by one or more lines to define a plurality of portions of said central region.

6. A set of cards according to claim 5 characterised in that in each portion of said central region of said card, there is provided either an aperture or printed indicia consisting of a single denomination, character suit shape or the like.

7. A set of cards according to claim 1 characterised in that the central region is divided into four portions by a series of two perpendicularly intersecting lines.

8. A set of cards according to claim 7 characterised in that one or more of the set of cards is solid in that it is not provided with an aperture, said cards being printed with indicia consisting of the four conventional playing card suits, one each in each portion of the central region defined by said intersecting lines.

9. A set of cards according to claim 7 characterised in that some of the cards are provided with a plurality of apertures, each aperture being located in one of the portions of the central region of the card where indicia would be printed if no aperture were provided.

* * * * *